US011453020B2

(12) United States Patent
Rankin, Sr.

(10) Patent No.: US 11,453,020 B2
(45) Date of Patent: Sep. 27, 2022

(54) BACKPACK PERSONAL DEFENSE MATERIAL DISPENSER

(71) Applicant: David Daniel Rankin, Sr., Yadkinville, NC (US)

(72) Inventor: David Daniel Rankin, Sr., Yadkinville, NC (US)

(73) Assignee: David Daniel Rankin, Sr., Yadkinville, NC (US)

( * ) Notice: Subject to any disclaimer, the term of this patent is extended or adjusted under 35 U.S.C. 154(b) by 0 days.

(21) Appl. No.: 17/337,578

(22) Filed: Jun. 3, 2021

(65) Prior Publication Data

US 2022/0055049 A1 Feb. 24, 2022

Related U.S. Application Data

(60) Provisional application No. 63/068,219, filed on Aug. 20, 2020.

(51) Int. Cl.

| | |
|---|---|
| ***B05B 9/08*** | (2006.01) |
| *A62C 15/00* | (2006.01) |
| *C11D 9/00* | (2006.01) |
| *F41H 9/10* | (2006.01) |

(52) U.S. Cl.

CPC ..... *B05B 9/0833* (2013.01); *A62C 15/00* (2013.01); *C11D 9/00* (2013.01); *F41H 9/10* (2013.01)

(58) Field of Classification Search

CPC ..... B05B 9/0833; A62C 15/00; C11D 9/00; F41H 9/10; A62D 1/0064

See application file for complete search history.

(56) References Cited

U.S. PATENT DOCUMENTS

| | | | | |
|---|---|---|---|---|
| 5,199,609 | A | 4/1993 | Ash, Jr. | |
| 5,921,435 | A * | 7/1999 | Billet | A45F 3/04 221/185 |
| 6,216,921 | B1 | 4/2001 | Spruill | |
| 6,378,740 | B1 | 4/2002 | Martin | |

(Continued)

OTHER PUBLICATIONS

Written Opinion (WO) for PCT/US2021/044276 dated Dec. 16, 2021 (5 pages).

(Continued)

*Primary Examiner* — Vishal Pancholi

(74) *Attorney, Agent, or Firm* — Shumaker, Loop & Kendrick, LLP

(57) ABSTRACT

A backpack material dispenser that includes a pumpless pressure tank for storing and discharging a material under pressure contained in the pressure tank and a hose and a shut off valve connected to an output opening of the pressure tank for allowing flow of the material from the pressure tank under pressure and through a nozzle communicating with a discharge end of the hose. A discharge valve communicates with the nozzle proximate the hose for allowing controlled discharge of the material from the nozzle. A backpack assembly mounts the pressure tank for being carried by a user. A charging tank contains a gas under pressure to charge the pressure tank to a predetermined pressure, and a releasable connector of the charging tank attaches to a complementary connector of the pressure tank for charging the pressure tank with the gas under pressure to the suitable pressure tank pressure.

7 Claims, 3 Drawing Sheets

(56) References Cited

U.S. PATENT DOCUMENTS

| | | | | |
|---|---|---|---|---|
| 8,091,583 | B2 * | 1/2012 | Olshanetsky | F02M 25/0872 137/493.2 |
| 8,672,364 | B2 * | 3/2014 | Schrum | B05B 9/043 222/401 |
| 2006/0102245 | A1 * | 5/2006 | Kaechle | B05B 9/0833 239/526 |
| 2020/0225008 | A1 | 7/2020 | Rankin, Sr. | |

OTHER PUBLICATIONS

International Search Report (ISR) for PCT/US2021/044276 dated Dec. 16, 2021 (2 pages).
PCT International Search Report and Written Opinion cited in International Application No. PCTUS2021044276; dated Dec. 16, 2021; 8 pages.

* cited by examiner

BACKPACK PERSONAL DEFENSE MATERIAL DISPENSER

PRIORITY CLAIM

This application claims priority from Provisional Patent Application Ser. No. 63/068,219, filed Aug. 20, 2020, the contents of which are incorporated herein by reference.

TECHNICAL FIELD AND BACKGROUND OF THE INVENTION

This invention relates to a defensive fluid material and pressurized delivery system for use by individuals, in classrooms, for law enforcement, crowd control, in commercial environments, and for firefighting. Specifically this invention relates to a defensive fluid chemical composition having high lubricity and a gel-like consistency contained in and dispensed from a pressurized system mounted on and carried by a user as a backpack.

In one embodiment, the product is formulated to temporarily impair vision, but not to cause pain or stinging to the eyes. In an alternative embodiment, the product is formulated to temporarily impair vision, and to cause temporary stinging to the eyes. Each will have utility in different situations.

In recent years, safety and security have become a top priority for the public in light of tragic events such as mass shootings, home invasions, and rioting. Numerous proposals of how the public can be protected and protect themselves have been discussed on a national and international scale. Many of the solutions to date, such as weapons and pepper spray, are not viable for various reasons.

One solution is for individuals to carry guns for protection. However, guns are not always accessible to the general public. Additionally, guns are often subject to bans in many locations such as schools, private businesses, and public spaces. Another problem is the training and experience required for the safe use and care of guns.

Pepper spray, chemical Mace®, tear gas, and other types of lachrymator agents are frequently used in crowd control and carried as personal protection. The basic idea is that the composition causes extreme irritation and/or inflammation to the target's eyes such that an assailant is disabled. While these methods have had success, many states and schools consider these personal defense sprays to be weapons and have added heavy regulation or outright banned their sale. Schools have generally banned students from carrying these types of sprays. Even in situations where these spray products are permissible, the use of these sprays which inflame or irritate the eyes of an assailant are only effective in close proximity to the assailant where the nose, mouth or eyes can be targeted. This greatly reduces the time for a targeted individual to escape. In addition, for 13% of the population pepper is not effective, and about the same percentage have negative respiratory issues. Because of the constituents, the materials identified in this application do not have these side issues and or collateral concerns.

There is a need for a product and pressurized delivery system that can be used as a personal defense spray and preemptively delay or disable an assailant, increasing the time for a targeted individual to escape.

There is also a need for a product and pressurized delivery system that has specific eye-irritating characteristics that dissipate without long-term damage to the eyes.

SUMMARY OF THE INVENTION

It is therefore an aspect of the present invention to provide a defensive fluid composition that disables or delays an assailant and can be applied preemptively to a surface and that is dispensed from a pressurized tank worn on the back of a user.

It is another aspect of the invention to provide a defensive fluid composition, which increases the lubricity of a surface.

It is another aspect of the invention to provide a defensive fluid composition that is biodegradable, non-toxic, water soluble, non-corrosive, and non-explosive.

It is another aspect of the invention to provide a defensive fluid composition that does not sting the eyes.

It is another aspect of the invention to provide a defensive fluid that causes temporary stinging to the eyes.

In all aspects of the invention, the defensive fluid is intended to have temporary effect with no injury to the eyes.

These and other objects and advantages of the present invention are achieved in one preferred embodiment set forth below by providing a backpack personal defense material dispenser that includes a pumpless pressure tank for storing and discharging under pressure a personal defense material, with a flow connector communicating with an interior of the pressure tank for receiving a gas under pressure for pressurizing the pressure tank and the material. A hose is connected to the flow connector for allowing controlled dispensing flow of the material from the pressure tank under pressure, and a backpack assembly is adapted to mount the tank for being carried on the back of a user. The backpack personal defense material dispenser is adapted to dispense under pressure a personal defense material, which may be a lubric gel composition for personal defense, which includes a fatty acid at a concentration ranging from 5 wt % to 10 wt % of the composition, a thickening agent at a concentration ranging from 1.75 wt % to 8.75 wt % of the composition, a detergent at a concentration ranging from 1.03 wt % to 4.07 wt % of the composition, a surfactant at a concentration ranging from 2 wt % to 15 wt % of the composition, and water at a concentration ranging from 66 wt % to 90.21 wt % of the composition.

According to another embodiment of the invention, a vile-smelling substance may be added to the composition, for example, a malodorant such as "Skunk MK-3", a biodegradable, organic water-based liquid sold by Mistral Security. http://www.mistralsecurityinc.com/Our-Products/Skunk/Self-Defense. Any malodorant that can be blended with the composition of the invention may be used.

According to another embodiment of the invention, a pressurized lubric gel composition delivery system for personal defense is provided which has a pressurized reservoir in the form of a backpack containing the composition and having a fluid outlet through which the composition can flow. A valve is connected to the fluid outlet of the reservoir having a closed position preventing flow of composition out of the reservoir and an open position enabling flow of composition out of the reservoir. A sprinkler head is adapted to receive and spray the composition when the valve is open.

BRIEF DESCRIPTION OF THE DRAWINGS

The present invention is best understood when the following detailed description of the invention is read with reference to the accompanying drawings, in which.

DETAILED DESCRIPTION OF THE PREFERRED EMBODIMENT

Figure 1:
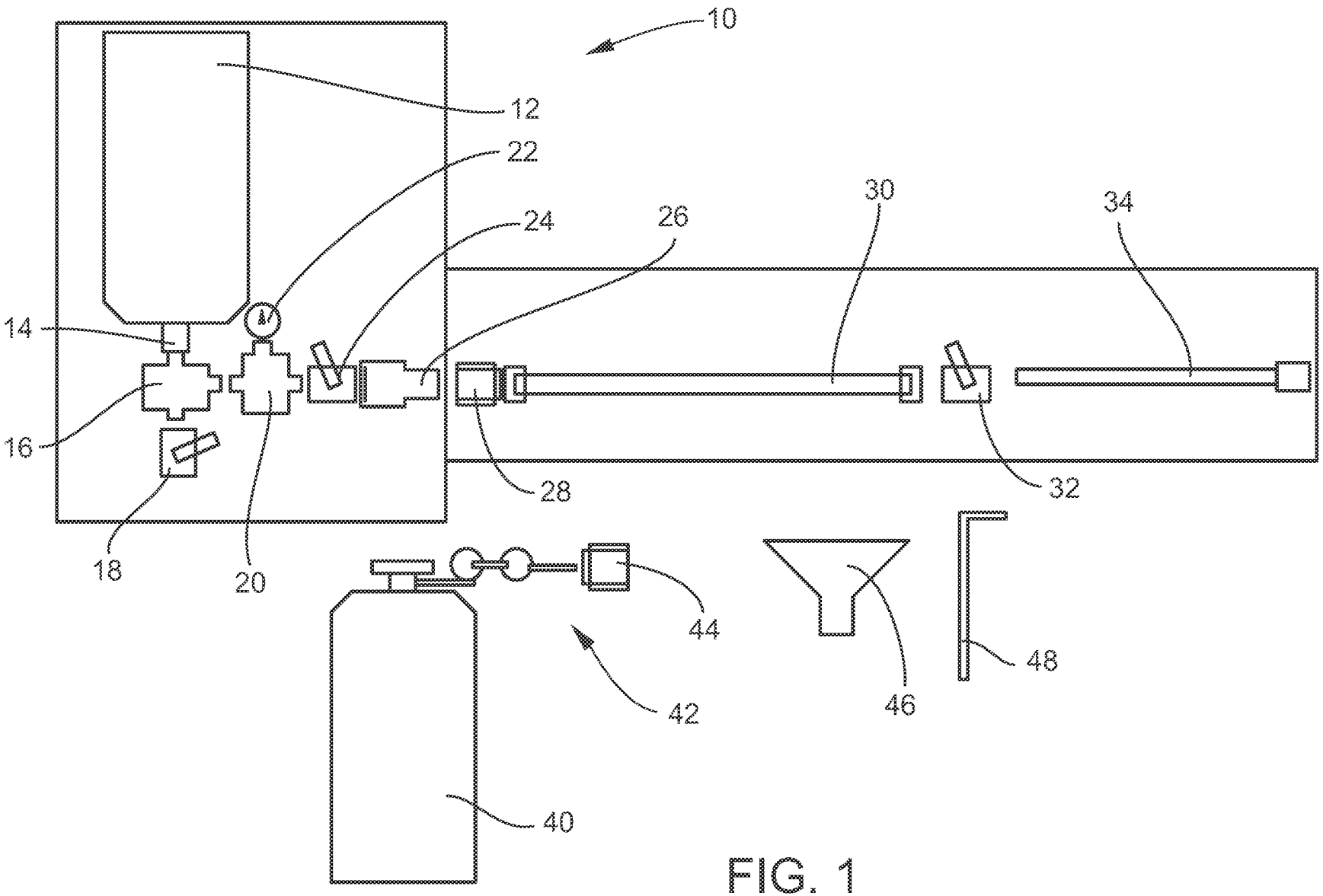
FIG. 1 is a circuit and flow diagram of a pressurized composition delivery system according to one aspect of the invention.

A lubric gel composition which can be applied to various surfaces for personal defense and a pressurized lubric gel composition delivery system is described. It is envisioned that the composition may be sprayed onto a wide variety of surfaces, such as concrete, tile, and wood or sprayed directly at an individual. When applied to surfaces, such as a walking surface, the composition creates a slick surface for the purposes of disabling or delaying an individual. A coating of the composition on an individual's hands increases difficulty of manipulating items such as weapons and doorknobs. The composition maintains a gel-like consistency when stored, sprayed, or coating a surface and does not foam in its natural state. This gel-like quality is important for maintaining the lubricity of the composition.

In addition to the primary purpose of increasing lubricity of a surface, the composition also has secondary features such as fire suppression/extinguishing and contact irritation of eyes/nose/mouth. Protective eyewear having a coating of the composition will smear when wiped and reduces visibility. The composition is also environmentally friendly, non-toxic, non-corrosive, non-lethal, and easily washable off surfaces.

Primary components of one preferred composition designed not to sting the eyes include a fatty acid, a thickening agent, a detergent, a surfactant, and water. Optionally, a preservative may be included. Other additives are envisioned such as dyes, illuminates, and/or phosphorescents, which leave a detectable signature on any individuals who came into contact with the defensive fluid. Each of the components may include multiple substances, or one substance may function as two of the components. The water is preferably deionized water at a concentration ranging from 66 wt % to 90.21 wt % of the overall solution.

A pre-mix is prepared which contains the fatty acid and the thickening agent. The fatty acid is preferably at a concentration ranging from 5 wt % to 10 wt % of the overall composition. The fatty acid coats the thickening agent to reduce clumping when exposed to water. The fatty acid also acts as a barrier film on hard surfaces and enhances lubricity. In one embodiment of the invention, the fatty acid is glycerin.

The thickening agent serves to increase the film strength and enhance lubricity. The thickening agent is preferably at a concentration ranging from 1.95 wt % to 13.75 wt % of the overall composition. In one embodiment of the invention, guar gum, methyl cellulose, and polyethylene oxide are included in the overall composition as thickening agents. Guar gum is preferably at a concentration ranging from 1 wt % to 5 wt % of the overall composition and methyl cellulose is preferably at a concentration ranging from 0.75 wt % to 3.75 wt % of the overall composition. Polyethylene oxide is preferably at a concentration ranging from 0.2 wt % to 10 wt % of the composition.

The detergent serves as a wetting agent to ensure the surface is wetted and can potentially enhance lubricity. The detergent is preferably at a concentration ranging from 1.03 wt % to 4.07 wt % of the overall composition. In one embodiment of the invention the detergent includes sodium laurel sulfate and sodium dioctyl sulfosuccinate. Sodium laurel sulfate is preferably at a concentration ranging from 1 wt % to 4 wt % of the overall composition and sodium dioctyl sulfosuccinate is preferably at a concentration ranging from 0.03 wt % to 0.07 wt % of the overall composition.

The surfactant serves to slow the rate of evaporation and provide enhanced lubricity. The surfactant is preferably at a concentration ranging from 2 wt % to 15 wt % of the overall concentration. In one embodiment, the surfactant comprises a non-ionic surfactant, an anionic surfactant, and an amphoteric surfactant. The amphoteric surfactant is coco amino propionate and is preferably at a concentration ranging from 2 wt % to 40 wt % of the surfactant.

A preservative may be added to the composition in order to increase longevity or self-life of the composition. The preservative is preferably at a concentration ranging from 0.01 wt % to 1.00 wt % of the overall composition. In one embodiment the preservative is sodium benzoate.

In the above formulation, a make-up diluent such as water is used to arrive at a total of 100 percent.

In accordance with another embodiment of the invention, a lubric gel composition which can be applied to various surfaces for personal defense and is intended to temporarily incapacitate an individual by impairing vision and causing a temporary stinging or burning sensation, without causing injury. A pressurized lubric gel composition delivery system includes Propylene Glycol at 0.1 wt % to 10 wt %; Citric acid at 0.1 wt % to 5 wt %; Trihydroxyborane at 0.1 wt % to 5 wt %, Pumicite at 0.1% to 5 wt % and Sodium chloride at 0.1 wt % to 10% wt; Cocoamide DEA at 0.1 wt % to 5 wt % and Phenoxyethanol at 0.025 wt % to 1 wt.

In accordance with yet another embodiment of the invention, a lubric gel composition which can be applied to various surfaces for personal defense and is intended to temporarily incapacitate an individual by impairing vision and causing a temporary stinging or burning sensation, without causing injury. A pressurized lubric gel composition delivery system includes Propylene Glycol at 0.1 wt % to 10 wt %; Citric acid at 5 wt % to 20 wt %; Trihydroxyborane at 0.1 wt % to 5 wt %, Pumicite at 0.1% to 5 wt % and Sodium chloride at 5 wt % to 20% wt; Cocoamide DEA at 0.1 wt % to 5 wt % and Phenoxyethanol at 0.025 wt % to 1 wt.

In a further embodiment, the composition may also include Polyvinyl Alcohol 1.0-5% and/or Boric Acid 0.125-1%.

These compositions causes temporary moderate to severe eye irritation, and reduces the ability for the eyes to open due to the irritation and gumminess of the solution.

Example No. 1

| | |
|---|---|
| Fatty acid | 5 wt % to 10 wt % |
| Thickening agent | 1.95 wt % to 13.75 wt % |
| guar gum | 1 wt % to 5 wt % |
| methyl cellulose | 0.75 wt % to 3.75 wt % |
| polyethylene oxide | 0.2 wt % to 10 wt % |
| Detergent | 1.03 wt % to 4.07 wt % |
| Surfactant | 2 wt % to 15 wt % |
| Preservative | 0.01 wt % to 1.00 wt % |
| Water | Sufficient to make up 100% |

Example No. 2

| | |
|---|---|
| Propylene Glycol | 0.1 wt % to 10 wt % |
| Citric acid | 0.1 wt % to 5 wt %; |

-continued

| | |
|---|---|
| Trihydroxyborane | 0.1 wt % to 5 wt %, |
| Pumicite | 0.1% to 5 wt % |
| Sodium chloride | 0.1 wt % to 10% wt; |
| Cocoamide DEA | 0.1 wt % to 5 wt % |
| Phenoxyethanol | .025 wt % to 1 wt. |
| Water | Sufficient to make up 100% |

Example No. 3

| | |
|---|---|
| Propylene Glycol | 0.1 wt % to 10 wt % |
| Citric acid | 5 wt % to 20 wt % |
| Trihydroxyborane | 0.1 wt % to 5 wt % |
| Pumicite | 0.1% to 5 wt % |
| Sodium chloride | 5 wt % to 20% wt |
| Cocoamide DEA | 0.1 wt % to 5 wt % |
| Phenoxyethanol at | .025 wt % to 1 wt % |
| Water | Sufficient to make up 100% |

Example No. 4

| | |
|---|---|
| Propylene Glycol | 0.1 wt % to 10 wt %; |
| Citric acid | 5 wt % to 20 wt % |
| Trihydroxyborane | 0.1 wt % to 5 wt % |
| Pumicite | 0.1% to 5 wt % |
| Sodium chloride | 5 wt % to 20% wt |
| Cocoamide DEA | 0.1 wt % to 5 wt % |
| Phenoxyethanol at | .025 wt % to 1 wt % |
| Polyvinyl Alcohol | 1.0-5% and/or Boric Acid 0.125-1% |
| Water | Sufficient to make up 100% |
| The high pressure unit may also be used to dispense soap. | |

Referring to FIG. 1, the system is described. The purpose of the system is to facilitate deployment of materials that are difficult to deploy using standard pumps and devices in the market. Systems such as fire extinguishers, small handheld or back-carried pumps and discharge units have been found unsuitable. Instead, the materials being ejected from the system need to be deployed using a high pressure, non-pump system.

To achieve this, a high pressure unit 10 is provided that includes a high-pressure tank 12 such as used for scuba or paintball activities. The tank 12 is preferably a light-weight composite material. An output opening adaptor 14 is fitted to the output opening of the pressure tank 12 and connected to a hydraulic street tee 16 and a fill valve 18. A hydraulic street tee 20 including a high pressure gauge 22 is connected to the fill valve 18 through the hydraulic street tee 16. A shut off valve 24 allows the pressure tank 12 to be shut off. Male and female connections 26 and 28, respectively, connect tank 12 to a hose 30. A discharge valve 32 allows the flow of the gel to be shut off at the hose 30. A spray nozzle 34 as required for the material being sprayed is attached to the output end of the hose 30. Certain of the above elements are shown as spaced-apart to clarify which part is being referenced.

The system 10 also includes a high pressure charging tank 40 filled with, for example, nitrogen, air or another suitable gas to charge the tank 12 to the suitable pressure. A female connector 42 of the charging tank 40 is attached to the male connector 26 to charge the tank 12.

Once assembled, the tank 12 and attached components are inverted with the output opening adaptor 14 at the top for filling. Fill valve 18 is opened and a funnel 46 and breathing tube 48 are inserted into the fill valve 18. The gel or other material to be discharged under pressure is poured into and through the funnel 46.

The breathing tube 48 allows for quicker flow of the material into the tank 12. Once filled to the required capacity the fill valve 18 is closed and the high-pressure charging tank 40 is connected by a charging valve 44 to valve 26 and the charging tank 40 is slowly opened with the charging valve 44 to begin the charging process. Shut off valve 24 is opened to allow the charge to occur. The pressure cannot exceed the tank or fitting-rated pressure. For example, the charging pressure may be 600 psi. Once charged, the shut off valve 24 is closed and the charging valve 44 is shut off after the charging tank 40 has completed the process of pressurizing the pressure tank 12. This can be done with an additional valve or by opening the connecting hose slightly from the charging tank 40 to the charging valve 44. An adaptor can be included for use with a pepperball charging compressor, with a charging compression of up to 1000 psi.

Once charged, the pressure tank 12 is inverted so that the output opening adaptor 14 is at the bottom, allowing gravity to feed the material to the tank opening at the output opening adaptor 14.

Figure 2:
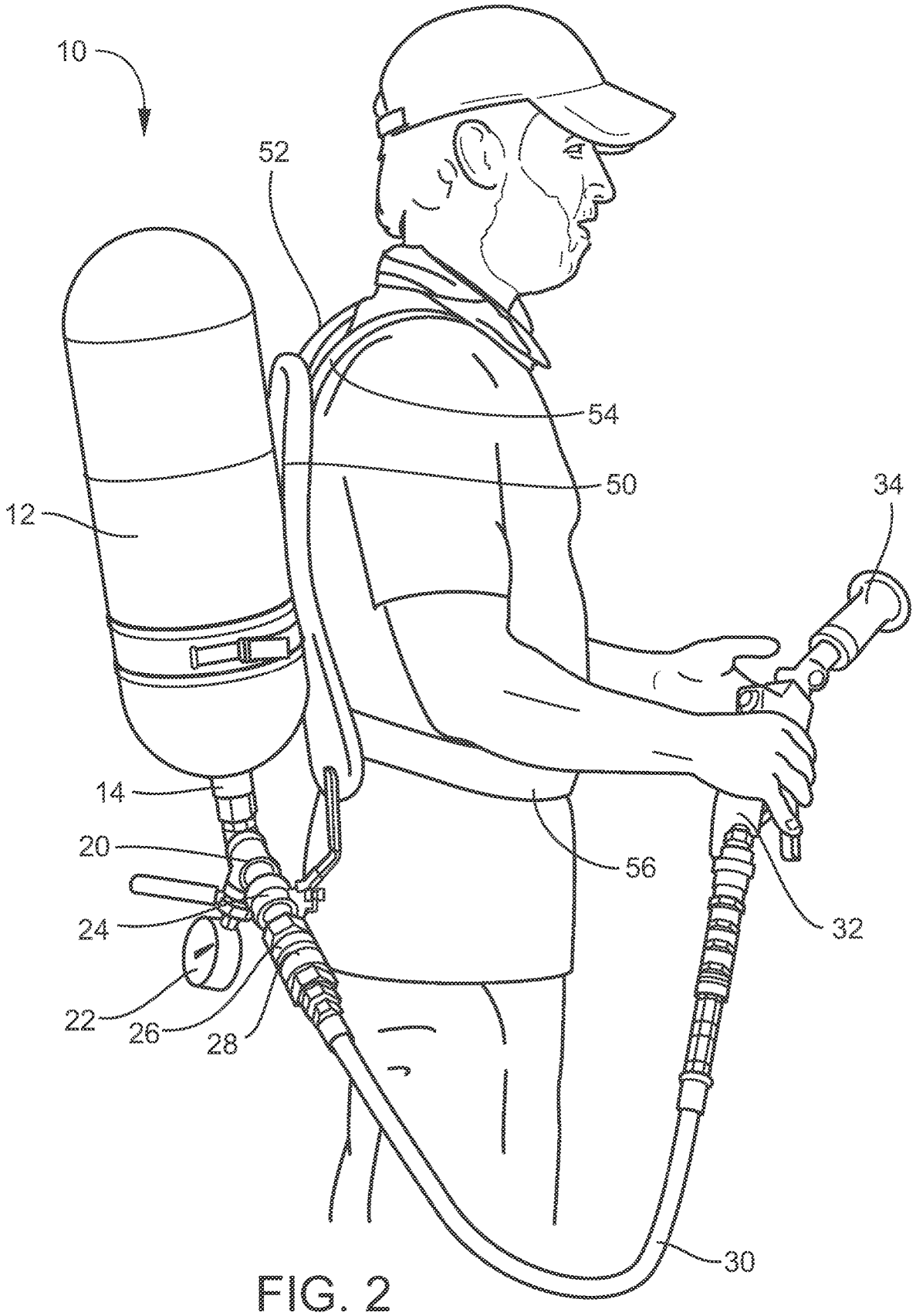
FIG. 2 is a rear view illustration of the pressure tank backpack as worn.
Figure 3:
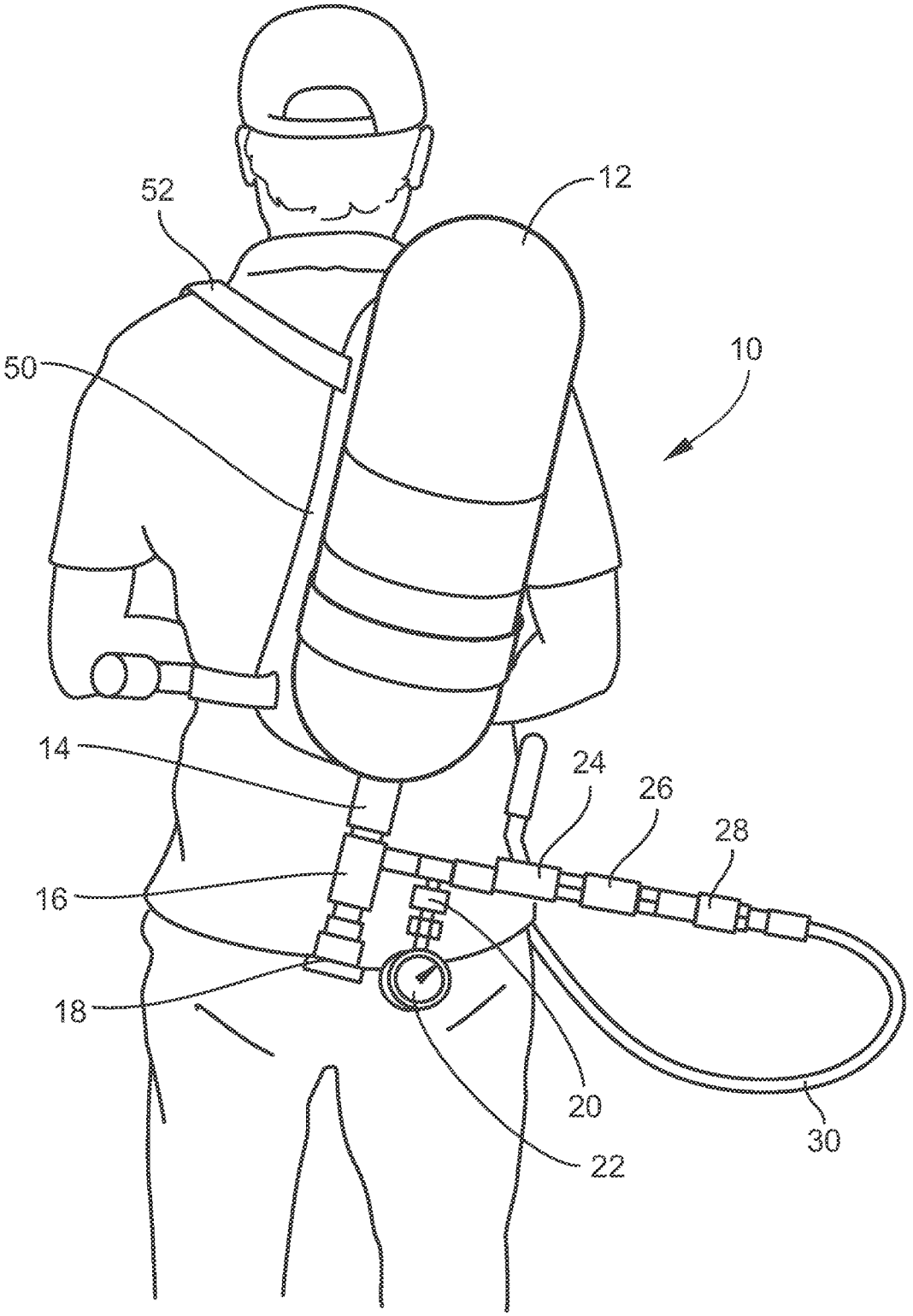
FIG. 3 is a side view illustration of the pressure tank backpack as worn.

Referring to FIGS. 2 and 3, the tank 12 and associated components are mounted on back cradle 50, which is donned by the user with carrying shoulder straps 52, 54 and a waist band 56.

The hose 30 is attached to the connector 28 and the unit is ready to use.

Selection of the correct spray valve 32 and nozzle 34 is determined by the material being sprayed. Ejection distances may range from 25 feet, and up to 60 feet depending on the material properties, a pressure of 1000 psi, nozzle settings and similar factors.

Other applications where the composition would be applied, such as utility poles before/during parades or riots may be performed, with other spray devices having varying strength of spray, width of spray, and shape of spray depending on the application. Other portable delivery systems are envisioned such as conventional spray bottles.

The backpack personal defense material dispenser, including materials suitable for dispensing from the dispenser according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A backpack material dispenser, comprising:

a. a pumpless pressure tank for storing and discharging a material under pressure contained in the pressure tank;

b. a hose and a shut off valve connected to an output opening of the pressure tank for allowing flow of the material from the pressure tank under pressure and through a nozzle communicating with a discharge end of the hose;

c. a discharge valve communicating with the hose and nozzle and adapted to permit controlled discharge of the material from the nozzle;

d. a charging tank adapted to contain a gas under pressure to charge the pressure tank to a predetermined pressure;

e. a charging valve adapted to attach to and communicate with the charging tank for charging the pressure tank with the gas under pressure to the suitable pressure tank pressure;

f. a tee connector interconnecting the shutoff valve and a fill valve for selectively permitting the pressure tank to be supplied with material when the shutoff valve is in a closed position and to be pressurized by the charging tank when the charging valve is connected to the shutoff valve in an open position allowing pressurized gas to flow from the charging tank through the open shutoff valve into the pressure tank; and g. a backpack assembly adapted to mount the pressure tank for being carried by a user.

2. The backpack material dispenser according to claim 1, wherein the material consists essentially of:

| | | |
|---|---|---|
| a. | Fatty acid | 5 wt % to 10 wt %; |
| b. | Thickening agent | 1.95 wt % to 13.75 wt %; |
| c. | guar gum | 1 wt % to 5 wt %; |
| d. | methyl cellulose | 0.75 wt % to 3.75 wt %; |
| e. | polyethylene oxide | 0.2 wt % to 10 wt %; |
| f. | Detergent | 1.03 wt % to 4.07 wt %; |
| g. | Surfactant | 2 wt % to 15 wt %; |
| h. | Preservative | 0.01 wt % to 1.00 wt %; and |
| i. | Water | Sufficient to make up 100%. |

3. The backpack material dispenser according to claim 2, wherein the material includes a preservative 0.01 wt % to 1.00 wt %.

4. The backpack material dispenser according to claim 1, wherein the material consists essentially of:

| | | |
|---|---|---|
| a. | Propylene Glycol | 0.1 wt % to 10 wt %; |
| b. | Citric acid | 0.1 wt % to 5 wt %; |

-continued

| | | |
|---|---|---|
| c. | Trihydroxyborane | 0.1 wt % to 5 wt %,; |
| d. | Pumicite | 0.1% to 5 wt %; |
| e. | Sodium chloride | 0.1 wt % to 10 wt %; |
| f. | Cocoamide DEA | 0.1 wt % to 5 wt %; |
| g. | Phenoxyethanol | .025 wt % to 1 wt %; and |
| h. | Water | Sufficient to make up 100%. |

5. The backpack material dispenser according to claim 1, wherein the material consists essentially of:

| | | |
|---|---|---|
| a. | Propylene Glycol | 0.1 wt % to 10 wt %; |
| b. | Citric acid | 5 wt % to 20 wt %; |
| c. | Trihydroxyborane | 0.1 wt % to 5 wt %; |
| d. | Pumicite | 0.1% to 5 wt %; |
| e. | Sodium chloride | 5 wt % to 20% wt; |
| f. | Cocoamide DEA | 0.1 wt % to 5 wt %; |
| g. | Phenoxyethanol | at .025 wt % to 1 wt %; and |
| h. | Water | Sufficient to make up 100%. |

6. The backpack material dispenser according to claim 1, wherein the material consists essentially of:

| | | |
|---|---|---|
| a. | Propylene Glycol | 0.1 wt % to 10 wt %; |
| b. | Citric acid | 5 wt % to 20 wt %; |
| c. | Trihydroxyborane | 0.1 wt % to 5 wt %; |
| d. | Pumicite | 0.1% to 5 wt %; |
| e. | Sodium chloride | 5 wt % to 20% wt; |
| f. | Cocoamide DEA | 0.1 wt % to 5 wt %; |
| g. | Phenoxyethanol | at .025 wt % to 1 wt %; |
| h. | Polyvinyl Alcohol | 1.0-5% and/or Boric Acid 0.125-1%; and |
| i. | Water | Sufficient to make up 100%. |

7. The backpack material dispenser according to claim 1, wherein the material consists essentially of soap and water.

* * * * *